United States Patent [19]

Sing

[11] Patent Number: 4,781,237

[45] Date of Patent: Nov. 1, 1988

[54] ROTARY VACUUM CASTING APPARATUS

[76] Inventor: Peter Sing, 168-10 84th Ave., Jamaica Hills, N.Y. 11432

[21] Appl. No.: 890,830

[22] Filed: Jul. 25, 1986

[51] Int. Cl.[4] ..... B22D 13/00

[52] U.S. Cl. ..... 164/255; 164/290; 425/434

[58] Field of Search ..... 164/61, 65, 254, 255, 164/286, 151, 290; 425/84, 85, 137, 145, 147, 149, 150, 425, 429, 435, 430, 434

[56] References Cited

U.S. PATENT DOCUMENTS

| | | | |
|---|---|---|---|
| 2,964,818 | 12/1960 | Reetz | 425/85 |
| 3,670,802 | 6/1972 | Krick et al. | 164/286 |
| 3,818,974 | 6/1974 | Eberle | 164/255 |
| 4,007,772 | 2/1977 | Laedtke et al. | 164/255 |
| 4,063,863 | 12/1977 | Hilmoe | 164/254 |
| 4,524,817 | 6/1985 | Brugger et al. | 164/254 |

FOREIGN PATENT DOCUMENTS

| | | | |
|---|---|---|---|
| 417231 | 7/1974 | U.S.S.R. | 164/61 |
| 556893 | 11/1977 | U.S.S.R. | 164/61 |
| 582886 | 12/1977 | U.S.S.R. | 164/255 |
| 761130 | 9/1980 | U.S.S.R. | 164/255 |

*Primary Examiner*—Jan H. Silbaugh
*Assistant Examiner*—Jill L. Fortenberry
*Attorney, Agent, or Firm*—Nathaniel Altman

[57] ABSTRACT

A method and apparatus for filling a mold having walls porous to gases by exposing external surfaces of the mold to a vacuum while filling the mold through an opening exposed to a higher pressure. The mold may be rotated at speeds sufficient for centrifugal forces to be produced to assist in filling cavities in the mold.

10 Claims, 2 Drawing Sheets

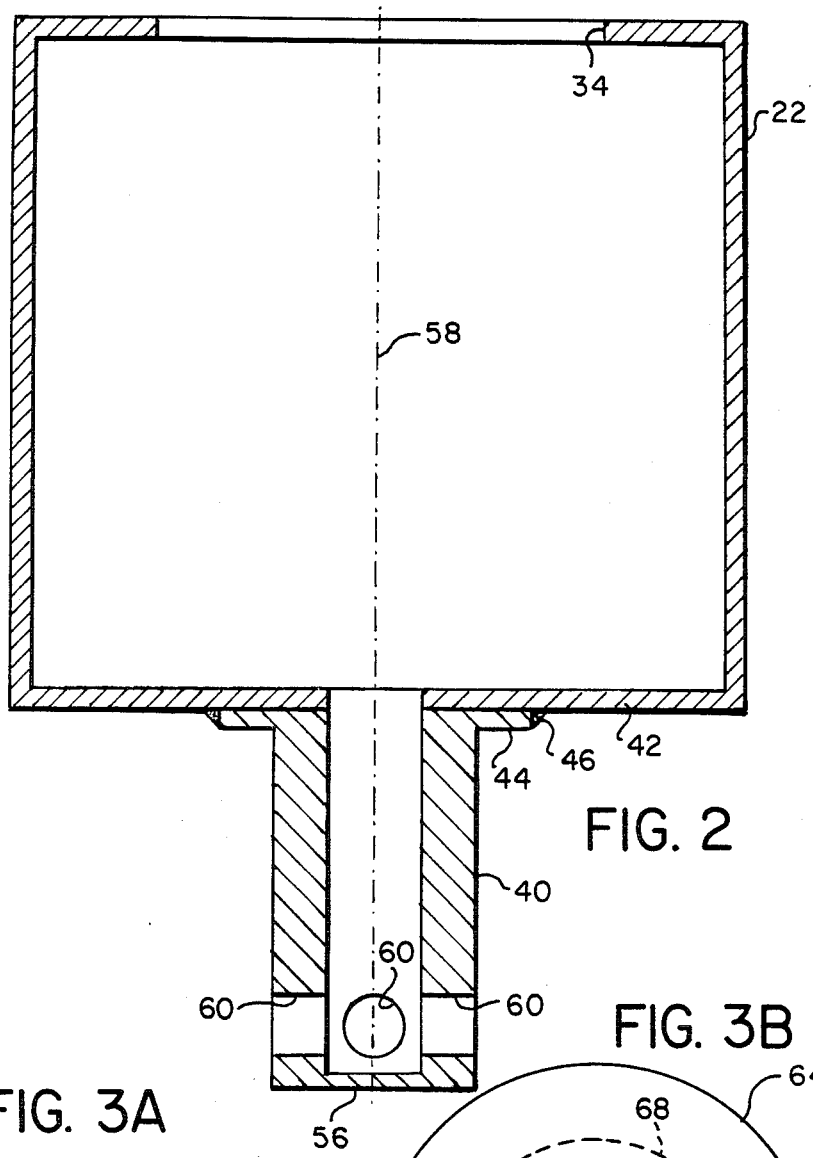
FIG. 2
FIG. 3A
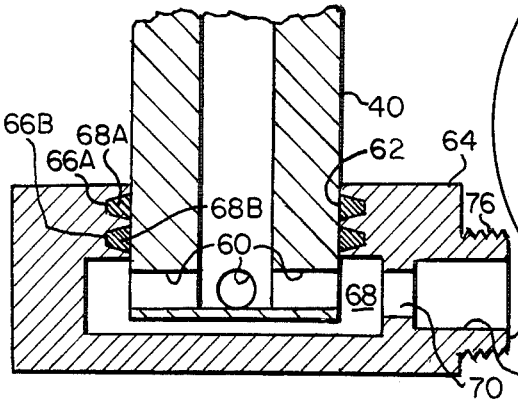
FIG. 3B
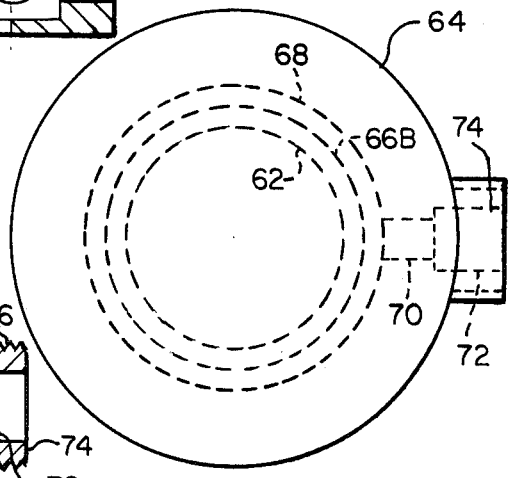

ROTARY VACUUM CASTING APPARATUS

BACKGROUND OF THE INVENTION

The invention relates to a rotary casting apparatus and method. More particularly, it relates to an apparatus and method wherein the quality of castings and the reliability of production of quality castings is enhanced with the aid of centrifugal force and a vacuum.

Conventional investment casting of the type used to produce cast parts which may be furnished for use as, for example, rings in the jewelry industry begins with the production of a master ∓tree" having a thin central cylindrical core and branches extending therefrom at an acute angle with respect to the core. The branches end in members having the shape of the objects to be cast. A flexible resilient mold is generally cast about the master and then the master is removed by stretching the mold and, if necessary, selectively parting the mold. The mold is carefully reassembled, and a molten material, such as wax, is poured into the mold. The mold is then cut away, leaving a wax duplicate of the master.

A casting cement mold is then created with the wax duplicate disposed therein and the core extending to a surface of the mold. The mold is heated to melt the wax, which is allowed to flow from the mold. Liquid metal is then poured into the opening corresponding to the core.

This method has several shortcomings. The liquid metal tends to be rapidly cooled and in many instances enough metal does not run down through the branches and into the members being cast to completely fill the members. Further, gases evolved during the casting process do not escape rapidly enough to prevent at least some of the castings from being adversely affected. In either case, castings are produced that are not usable and the material from which these castings are formed must be recast. This results in a loss of labor and materials which greatly increases the cost and limits the productivity of the casting process.

It is a principal object of the invention to provide an apparatus and method for casting which consistently produces castings of high quality.

It is an object of the invention to provide a casting apparatus which is relatively simple and inexpensive.

It is a further object of the invention to provide a method of casting which is relatively inexpensive to use.

It is yet another object of the invention to provide an apparatus and method of casting which efficiently fills the mold with molten material.

It is still another object of the invention to provide an apparatus and method of casting which efficiently removes evolved gas from the mold.

SUMMARY OF THE INVENTION

In accordance with the invention, a mold has walls which are porous to gases within the mold. A vacuum means is provided for creating a region of vacuum around the mold to draw the gas from the mold. A rotation means rotates the mold about a rotational axis thereof. A pressure switch determines when pressure in the region of vacuum has dropped below a predetermined level to then actuate the rotation means. The vacuum means includes a chamber for receiving the mold so that a surface thereof remains exposed to atmosphere for receiving molten material, such as a molten metal, through an opening therein, the material being provided from outside the chamber.

In accordance with the method of the invention, a mold having walls which are porous to gases is filled by exposing substantial portions of the walls of the mold to a vacuum and filling a cavity in the mold with molten material, through an opening in the mold not exposed to the vacuum; that is, the opening is exposed to a higher pressure. The mold is rotated about a rotational axis thereof while filling the cavity. Such rotation is at a rate sufficient to cause the molten material to be centrifugally forced into the cavity.

BRIEF DESCRIPTION OF THE DRAWINGS

In order that the invention may be more readily understood, reference is made to the accompanying drawings, wherein:

FIG. 2 is a cross sectional view of a component of the apparatus of FIG. 1;

FIG. 3A is an enlarged cross sectional view of a portion of the apparatus of FIG. 1; and FIG. 3B is a bottom, plan view of the portion of the apparatus illustrated in FIG. 3A.

DETAILED DESCRIPTION OF THE PREFERRED EMBODIMENT

Figure 1:
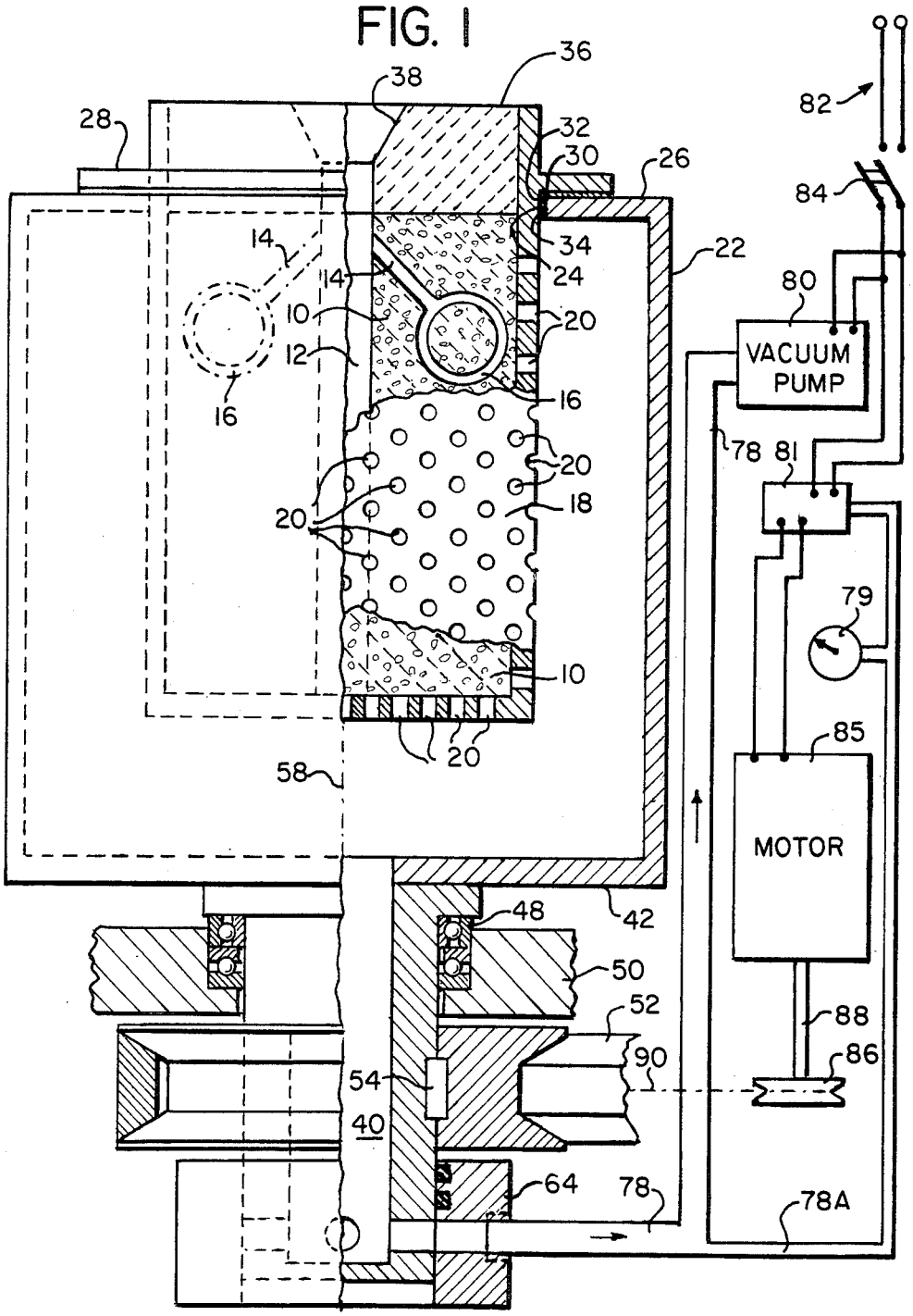
FIG. 1 is a side elevational view, in partial cross-section, of an apparatus according to the invention schematically showing the interconnection of the several components thereof.

Referring to FIG. 1, a cylindrical cement casting mold 10, has a cylindrical longitudinally extending cylindrical channel 12 from which numerous passageways or branches 14 extend downwardly at an acute angle. Each branch 14 leads to a cavity 16 in the shape of the article to be cast. Mold 10 is received in a relatively tight fitting cylindrical mold container 18. Container 18 has a series of holes 20 which permit the external wall of mold 10 to be exposed to the interior of a chamber 22. Chamber 22 has an opening 24 in its upper wall 26 dimensioned to receive container 18. An integral flange 28 extends outwardly from the wall of container 18. An 0-ring 30, received in an annular recess 32 provides an air tight seal between the wall of container 18 and a facing surface 34 of chamber 22 defined by opening 24. A cylindrical refractory member 36 is snuggly received in container 18 over mold 10. Member 36 has a chamferred opening 38 which is aligned with channel 12 in mold 10 so that molten material poured into opening 38 is guided into channel 12.

Referring also to FIG. 2, chamber 22 has a cylindrical extension 40 affixed to its lower wall 42 by a flange 44. Flange 44 may be affixed to wall 42 by a circumferential weld 46, or in any other way which provides an air tight seal between chamber 22 and extension 40.

Referring again to FIG. 1, extension 40 is received in a ball bearing 48. Bearing 48 is in turn supported by a base member 50.

A pulley 52 is fitted on to a portion of extension 40 extending below base member 50. Extension 40, and therefore, chamber 22, are constrained to rotate together with pulley 52 due to the presence of a key 54 which serves to rotationally lock pulley 52 and extension 40.

The lower end of extension 40 may have an integral lower wall 56 perpendicular to the common longitudinal or rotational axis 58 of chamber 22 and extension 40. In this case several holes 60, for example a total of four, may be drilled in the cylindrical wall 40 parallel to lower wall 56.

Referring also to FIG. 3A and FIG. 3B, the end of extension 40 fits into a cylindrical opening 62 in a cylindrical housing 64 which is secured against rotation by, for example, coupling to base member 50. The wall defining opening 62 has recesses 66A and 66B for receiving gaskets 68A and 68B, respectively, so that an air tight seal is formed between the outer wall of extension 40 and housing 64, while permitting extension 40 to rotate with respect to housing 64.

Extension 40 is positioned at a level in housing 64 so that openings 60 of extension 40 are aligned with a chamber 68 to which opening 62 leads. A short passageway 70 extends from chamber 68 to a channel 72 which extends into a cylindrical nipple 74 integrally formed with housing 64. Threads 76 may be provided on the external surface of nipple 74 to facilitate coupling to a vacuum pipe or hose 78 (FIG. 1).

Referring to FIG. 1, vacuum hose 78 is connected to a vacuum pump 80 which serves to evacuate chamber 22. Pump 80 is powered by a motor which operates on power from available alternating current power lines 82 when a SPDT switch 84 is closed.

Vacuum hose 78 has a branch 78A which connects to a vacuum gauge 79 and a pressure switch 81. When the pressure in hose 78A (and therefore also chamber 22) reaches a low enough predetermined vacuum level, pressure switch 81 provides line power to a motor 85. A pulley 86 on shaft 88 of motor 85 is coupled to pulley 52 by a belt 90. Rotation of shaft 88 thus causes chamber 22 to rotate after a suitable vacuum has been established in chamber 22.

In operation, mold 10 made by the casting technique discussed above is placed in container 18 so as to be in contact with the bottom wall thereof. Mold 10 must be made of a material that is porous to gases but not to the molten material being cast, such as casting cement of a type well known in the jewelry industry. Refractory member 36 is then inserted into container 18 to cover mold 10.

Container 18 is inserted into chamber 22 with flange 28 in contact with upper wall 26 of chamber 22. Switch 84 is closed. Pump 80 evacuates chamber 22 and activates pressure switch 81 causing motor 85 to begin operating to rotate chamber 22. Because opening 38 is on a rotational axis 58 of chamber 22, it presents no difficulty to fill the cavities of mold 10 through opening 38. Evolved gases in mold 10 are drawn out through the porous material thereof by way of holes 20, into chamber 22. Centrifugal forces generated by rotation tend to combine with the force of gravity to draw material down branches 14 to cavities 16, thus filling the cavities completely before the molten material can solidify.

As used herein the term "vacuum" refers to pressures created by any suitable vacuum pump and therefore includes partial vacuums. In other words, a "hard" vacuum is not required.

Various modifications to the invention will occur to those skilled in the art. For example, pressure injection means (not shown) of a type well known in the art may be provided to inject material into the mold at pressures greater than atmospheric pressure.

Although shown and described in what is believed to be the most practical and preferred embodiment, it is apparent that departures from the specific method and designs described and shown will suggest themselves to those skilled in the art and may be made without departing from the spirit and scope of the invention. I, therefore, do not wish to restrict myself to the particular construction described and illustrated, but desire to avail myself of all modifications that may fall within the scope of the appended claims.

I claim:

1. A rotary investment casting apparatus for producing molded jewelry objects of improved quality from molten metal by eliminating incomplete filling of the mold and by removing gaseous material form both the mold and the molten metal to avoid gas pockets and porosity in the molded objects, comprising:

a gas-permeable investment mold having been formed in one piece of material porous to gases by encompassing wax impressions of the objects to be molded in said porous material and after the setting of said mold, melting and removing the wax, said mold being positioned for rotation about its central vertical axis and having a plurality of cavities in the shape of the objects to be molded, each of said cavities extending directly from a branch passage connecting each of said cavities to a centrally disposed vertical feed opening in said mold, said branch passages being oriented at a downwardly acute angle with respect to said central vertical axis of said investment mold and being distributed throughout said investment mold in tree-branch-like fashion, said cavities being exposed to pressure from above and outside said investment mold;

means for creating a region of partial vacuum peripherally surrounding the porous walls and porous bottom of said mold uniformly to withdraw gases from said gas-permeable mold, from said shaped cavities and from the molten metal poured therein before it solidifies; and means for rotating said mold in erect vertical position about said central vertical axis thereof, whereby, when the casting apparatus is actuated and the molten metal poured into said investment mold, the combined centrifugal, gravitiational and pressure differential forces being multi-directionally exerted on said angularly disposed cavities and the molten metal therein to ensure both the complete filling of said cavities and the absence of gas pockets in the molded object, said pressure differential force resulting from the higher pressure from outside said mold combining and acting in concert with the lowered pressure created within said mold by said means for creating a region of partial vacuum.

2. The rotary investment casting apparatus of claim 1, further comprising pressure responsive switch means for actuating said means for rotating said mold when the pressure surrounding said mold has been decreased to a predetermined level by the action of said means for creating a partial vacuum.

3. The rotary investment casting apparatus of claim 1, further comprising means for supporting and surrounding the sides and bottom of said gas-permeable investment mold, said support and surrounding means having openings therein to expose portions of the exterior walls of said mold to the lowered pressure produced by said means for creating a partial vacuum.

4. The rotary investment casting apparatus of claim 3, wherein said centrally disposed verticaly feed opening in said gas-permeable investment mold extends downwardly from the top of said mold, said feed opening communicating with said cavities through said downwardly angled passages and for filling said cavities with molten metal from outside said mold, said feed opening being exposed from above to a pressure greater than the lowered pressure produced by said means for creating a region of partial vacuum peripherally surrounding the walls and bottom of said mold, whereby the molten metal for filling said cavities is forced completely therein by the simultaneous combined centrifugal, pressure differential and gravity forces exerted thereon.

5. The rotary investment casting apparatus of claim 4, wherein said feed opening in said investment mold is exposed from above and outside to a pressure at least as great as atmospheric pressure.

6. The rotary investment casting apparatus of claim 1, further comprising a refractory member positioned over said investment mold, said refractory member having a centrally disposed opening for allowing the flow of poured molten material therethrough into and through the corresponding said centrally disposed opening in said investment mold and into said mold cavities therein.

7. The rotary investment casting apparatus of claim 4, wherein said means for creating a region of partial vacuum around said mold comprises:

a chamber concentric with and for containining said investment mold and said support structure, said chamber being so constructed that said centrally disposed opening in said investment mold remains exposed for receiving molten material form outside said chamber, both said centrally disposed opening in said investment mold and the molten metal poured therein being thereby subjected to a pressure greater than the pressure existing within said chamber; and said means for creating a region of partial vacuum around said gas-permeable mold being a vacuum pump for evacuating said chamber.

8. The rotary investment casting apparatus of claim 7, wherein said means for rotating said mold about its central vertical axis comprises:

means for rotating said chamber;

means for operatively keying said investment mold, said support means and said chamber for joint simultaneous rotation about a common vertical axis by the action of said means for rotating said chamber; and means for operatively coupling said vacuum pump to said chamber, whereby said vacuum pump is capable of forming and maintaining a partial vacuum within said chamber and said investment mold while said chamber is being rotated.

9. The rotary investment casting apparatus of claim 8, wherein said rotation means for rotating said chamber comprises:

a motor; and means for coupling said motor to said chamber so that said chamber is rotated when said motor is actuated.

10. An improved rotary casting apparatus for producing molded jewelry objects form molten metal, which comprises:

an investment mold formed in one piece of gas-permeable material using wax impressions and positioned for rotation about its central vertical axis, said mold having a centrally disposed feed opening extending vertically downwardly from the top of said mold, said feed opening being exposed from above to external pressure and having a plurality of branch passages, said branch passages emanating from said feed opening and arranged in tree-branch-like fashion, said passages extending angularly downwardly directly to and for filling a plurality of cavities, said cavities being shaped in the form of objects to be molded;

support structure means for containing and supporting said investment mold, said support means being open at its top and having spaced openings distributed throughout the peripheral walls and bottom thereof to expose substantial portions of the exterior of said investment mold;

a chamber concentric with, and for containing, said investment mold and said support means, said chamber being so constructed that said centrally disposed feed opening in said investment mold remains exposed to permit molten metal to be poured therethrough from outside said chamber;

fixed mounting means for supporting said chamber for rotation thereon about said vertical axis common to said investment mold, said support structure means and said chamber;

means for rotating said chamber, said support sturcture means and said investment mold in unison about said centrally disposed common vertical axis thereof;

means for creating a region of partial vacuum within said chamber, whereby said substantial portions of the exterior of said investment mold, through said openings in said support means, are surrounded by and subjected to the reduced pressure provided by said region of partial vacuum;

coupling means for connecting said fixed mounting means to said means for creating a region of partial vacuum so that the partial vacuum may be created and maintained within said chamber while said means for rotating said chamber is causing said chamber, said support means and said investment mold to rotate about said common vertical axis; and pressure-responsive switch means for actuating said means for rotating said chamber, said support structure and said investment mold in unison when the pressure surrounding said mold has been decreased to a predetermined level by the action of said means for creating a region of partial vacuum, whereby the molten metal poured thereafter into said centrally disposed feed opening in said investment mold is forced into said shaped cavities therein and the gaseous pockets eliminated therefrom by the combination of centrifugal, gravity and pressure differential forces, said pressure differential force resulting from the higher pressure exerted from outside said mold in combination with the lower pressure of the partial vacuum being created within said mold.

* * * * *